US008215578B2

(12) United States Patent
Naulet et al.

(10) Patent No.: US 8,215,578 B2
(45) Date of Patent: Jul. 10, 2012

(54) DEVICE FOR MAINTAINING A YARN IN A SPOOLER

(75) Inventors: Christophe Naulet, Chambery (FR); Jean-Michel Cogniaux, La Motte Servolex (FR); Pascal Frayer, Drumettaz Clarafond (FR)

(73) Assignee: Saint-Gobain Technical Fabrics Europe, Chambery (FR)

( * ) Notice: Subject to any disclaimer, the term of this patent is extended or adjusted under 35 U.S.C. 154(b) by 834 days.

(21) Appl. No.: 11/631,849

(22) PCT Filed: Jun. 29, 2005

(86) PCT No.: PCT/FR2005/050518

§ 371 (c)(1),
(2), (4) Date: Feb. 14, 2007

(87) PCT Pub. No.: WO2006/005883

PCT Pub. Date: Jan. 19, 2006

(65) Prior Publication Data

US 2008/0290205 A1 Nov. 27, 2008

(30) Foreign Application Priority Data

Jul. 8, 2004 (FR) ..... 04 07599

(51) Int. Cl.
*B65H 54/28* (2006.01)
*B65H 54/20* (2006.01)
*B65H 57/28* (2006.01)

(52) U.S. Cl. ..... 242/476.9; 242/157 R; 242/615.1

(58) Field of Classification Search ..... 57/401, 57/409, 66.5; 242/476.9, 482.9, 615.1, 157 R, 242/474.7, 475, 477, 474.8
See application file for complete search history.

(56) References Cited

U.S. PATENT DOCUMENTS

| | | | | |
|---|---|---|---|---|
| 3,292,871 | A * | 12/1966 | Smith et al. | 242/474.5 |
| 3,819,122 | A * | 6/1974 | Genson | 242/477 |
| 4,052,016 | A | 10/1977 | Cunningham et al. | |
| 4,167,252 | A | 9/1979 | Klink et al. | |
| 6,067,928 | A | 5/2000 | Holzer, Jr. et al. | |
| 6,070,827 | A * | 6/2000 | Spahlinger et al. | 242/474.5 |

FOREIGN PATENT DOCUMENTS

| | | |
|---|---|---|
| FR | 1 246 431 | 11/1960 |
| FR | 1 321 643 | 3/1963 |
| FR | 2 150 091 | 3/1973 |
| FR | 2 432 466 | 2/1980 |
| JP | 52 140628 | 11/1977 |
| JP | 8 290869 | 11/1996 |
| JP | 2001 89027 | 4/2001 |

* cited by examiner

*Primary Examiner* — Michael Mansen
*Assistant Examiner* — Stefan Kruer
(74) *Attorney, Agent, or Firm* — Oblon, Spivak, McClelland, Maier & Neustadt, L.L.P.

(57) ABSTRACT

A winder including a frame. The frame includes at least one spindle configured to support at least one package, the spindle rotating about a first axis approximately perpendicular to the diameter of the package so as to draw and wind at least one strand in the form of a package, and at least one positioning and guiding device configured to position and guide at least the strand on the rotating spindle. A keeper is configured to keep the strand in contact with the positioning and guiding device.

4 Claims, 2 Drawing Sheets fig 1
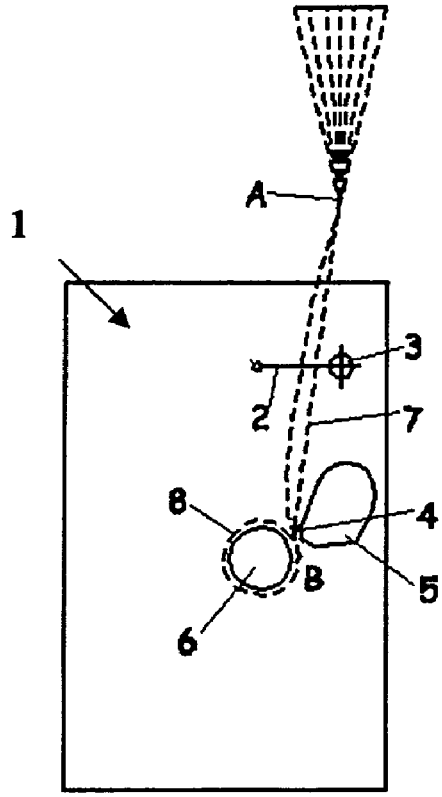
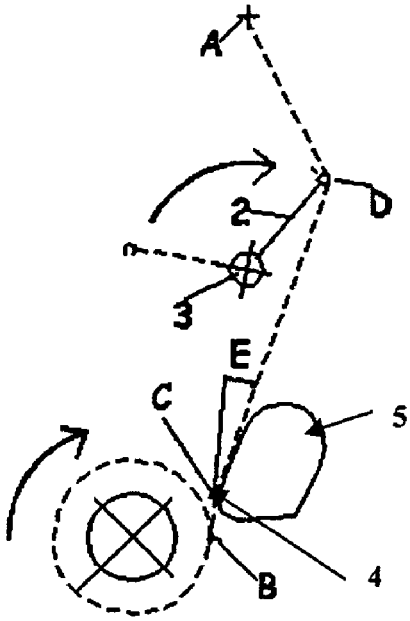
Fig.2
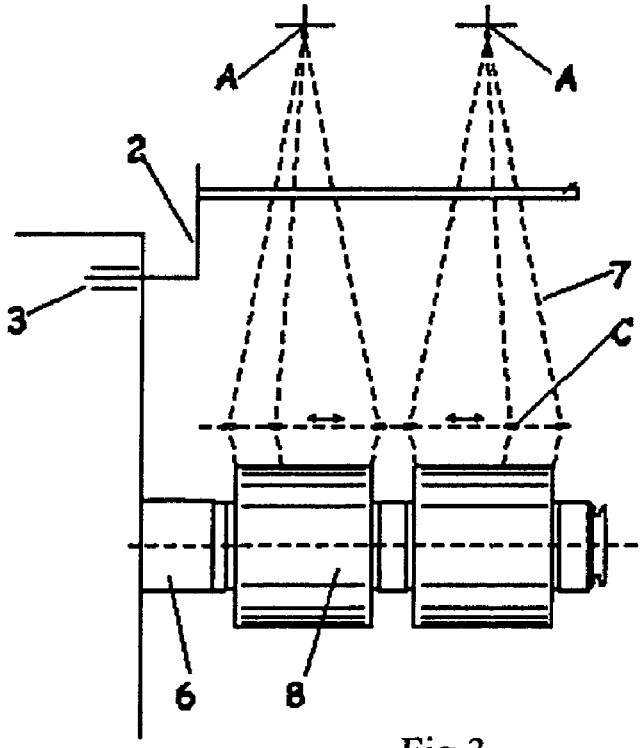
Fig.3

Fig.4
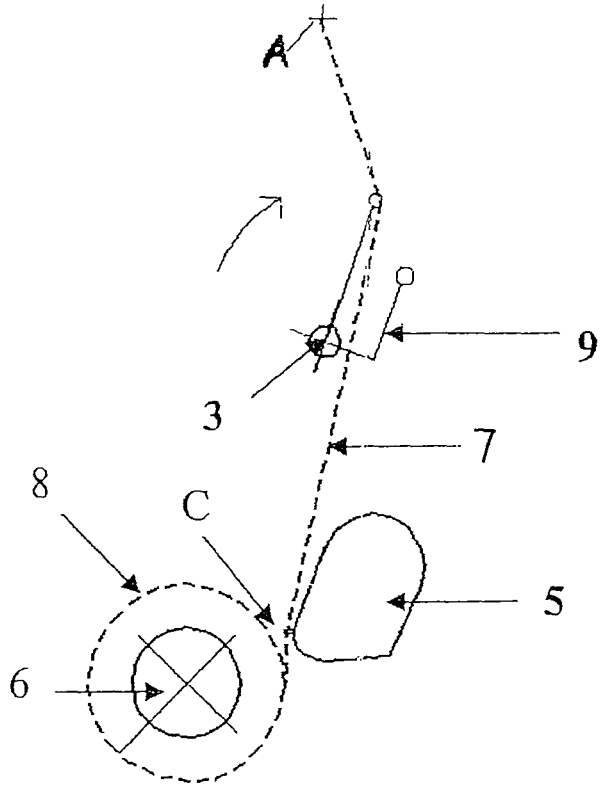
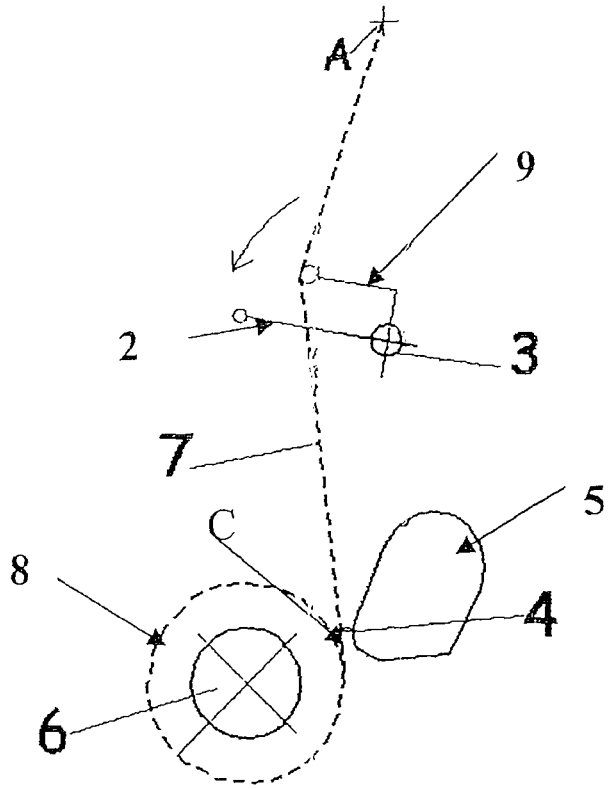
Fig.5

DEVICE FOR MAINTAINING A YARN IN A SPOOLER

The present invention relates to a device for the drawing and winding of organic or mineral strands, especially glass strands. More particularly, it relates to a keeper for keeping a strand within a winder.

It will be recalled that the manufacture of glass reinforcement strands results from a complex industrial process that consists in obtaining strands from streams of molten glass flowing out through the orifices of bushings. These streams are drawn in the form of continuous filaments, these filaments are then collected into base strands and then these strands are collected in the form of a package.

Within the meaning of the invention, the packages are in the form of wound packages with straight flanges or in the form of cylindrical packages.

The package-forming operation is carried out using winders, which as their name indicates are responsible for winding, at very high speed (about 10 to 50 meters per second), the glass strands that have been presized.

These winders draw and wind these filaments, and the operating parameters of these winders, together with those of the bushing, determine the dimensional characteristics of the strand, especially the linear density expressed in tex (tex being the weight in grams of 1000 meters of fiber or strand).

Thus, to guarantee a constant linear density of the strand throughout the package production phase, despite the increase in its diameter, the speed of the winding member of the winder is slaved so as to ensure a constant linear winding speed of the strand although its angular speed varies, this speed slaving operation being carried out by reducing the rotation speed of the spindle that supports the package according to the increase in its diameter.

Another important parameter upon which the formation of a package of optimum quality is conditional consists of its ability to be easily unwound, with no loops, no parasitic knots and with limited friction.

To do this, it is necessary that the precision in the resulting deposition of an axial distribution of the strands wound directly onto the rotating spindle be optimal. For this purpose, the winder is provided with one or more strand guides which ensure that the strands are distributed axially along one or more packages by a traversing motion synchronized with the rotation of the spindle, this strand guide or guides forming part of a subassembly of the winder, which is generally called a crossover device.

This crossover device is mounted on a moveable support allowing it to be permanently repositioned during winding, parallel to the spindle axis, in order to keep it at a certain distance between the strand guide or guides and the external cylindrical surface of the package or packages, the diameter of which continues to increase over its or their construction.

The known winders essentially consist of a frame generally positioned beneath a bushing, this frame supporting the crossover device and at least one rotating spindle, this spindle being designed, on the one hand, to generate the package and, on the other hand, to support the latter.

Conventionally, a crossover device comprises a member shaped in the form of a cursor that moves linearly within a groove, this moving cursor allowing the strand to be positioned on the rotating spindle and the movement impressed by the cursor essentially consisting of an oscillatory or flapping movement only along one dimension of the package.

To obtain a wound package, the cursor is mounted so as to undergo a traversing motion translationally on a shaft fastened to the frame and parallel to the axis of the spindle, this second translational motion thus making it possible to cover the length of the package.

It will be understood that, to describe the entire length of the package, the strand moves from a substantially fixed point located generally downstream of the bushing, this point being called the gathering point, in a triangle whose opening substantially encompasses the total length of the package.

The entire manufacturing range leads in certain cases to the strands undergoing vibrations which may flap between the two stable points located, on one side, near the gathering point and the point where the strand is deposited on the package, it being possible for this vibration or flapping movement to cause the strand to escape out of the crossover device and therefore result in the package winding phase being stopped before its completion.

The present invention therefore aims to alleviate these drawbacks by proposing a device that prevents any ejection of the strand from the crossover device during the package winding phase and which improves the quality and precision with which the strand is deposited, despite the increase in package thickness (which is primarily important during the drying phase) and increase in speeds (during subsequent unwinding phases).

For this purpose, the winder according to the invention essentially comprising a frame, this frame having at least one spindle designed to support at least one package, said spindle rotating about a first axis approximately perpendicular to the diameter of the package so as to draw and wind at least one strand in the form of a package, and at least one positioning and guiding device designed to position and guide at least said strand on the rotating spindle, it being possible for said device to move closer toward or further away from the package while it is being wound, is characterized in that it further includes a keeper designed to keep said strand in contact with said positioning and guiding device.

Thanks to these arrangements and especially to the presence of the keeper, the strand is kept constantly in contact with the positioning and guiding device, which helps to eliminate any risk of ejection or flapping of the strand during the winding phase.

In preferred embodiments of the invention, one or more of the following arrangements may optionally be furthermore applied:

- the keeper is mounted so as to move relative to the frame and travels between a rest position, in which the strands are away from the positioning and guiding device, and a working position, in which the strands are in contact with said positioning and guiding device;
- the keeper is mounted so as to rotate relative to a second axis approximately parallel to said first axis of rotation;
- the keeper essentially comprises a bar supported by an arm articulated about the second axis of rotation, this arm being controlled angularly by an indexer;
- the keeper also includes a rotary arm for ejecting the strands, which serves to extract said strands from the positioning and guiding device when they are being transferred from one spindle to another, or upon strand winding onto a spindle following a strand breakage; and
- the indexer is designed to continuously modify the angular position of the keeper relative to the frame according to the variation in outside diameter of the package so as to minimize the travel of the strand between its point of contact with the positioning and guiding device and its point of contact on the periphery of the package.

Other features and advantages of the invention will become apparent over the course of the following description of one of its embodiments, given by way of nonlimiting example and with reference to the drawings appended hereto.

In the drawings:

FIG. 1 is a schematic front view of a winder according to the invention;

FIG. 2 is a front view of the winder showing the path of a strand;

FIG. 3 is a side view of FIG. 2;

FIG. 4 is a front view of the winder in which one embodiment of the keeper is shown in a first position; and FIG. 5 is similar to FIG. 4, but with the keeper in a second position.

According to a preferred embodiment of a winder 1 according to the invention, illustrated in FIG. 1, this comprises a metal frame obtained by a technique whereby metal elements, which are premachined or commercially available as standard products, are welded together. This frame essentially comprises a substantially rectangular base resting on judiciously placed feet so as to correspond to the configuration or spacing of the forks of a pallet stacker or of a similar handling device so as to make it easier to install this winder in a fiberizing position.

Joined onto this base is a partly covered closed structure that is intended to receive all the components needed to operate the winder 1. In this regard, but nonlimitingly, this closed structure shaped in the form of a cabinet is provided with the control and operating devices needed to control the various members, which will be described later in the present description, and hydraulic, electrical, compressed-air and other fluid systems needed to operate said members.

A drum that projects laterally is fitted onto the closed structure. This drum is mounted so as to rotate about an axis of rotation and is held in place within one of the walls of the closed structure by means of a plurality of guiding members (for example a ball bearing ring or ball bearing slide).

This drum in fact constitutes a spindle-support assembly. FIG. 1 shows that the drum has only a single spindle 6 (it would be conceivable for a drum to have several spindles in diametrically opposed positions [if there is only one spindle, it is not possible to carry out the automatic transfer] or, on the contrary, a drum having at least three, four or even more spindles, depending on the available size and the capacity of the bushing positioned upstream). In the winder 1, the drum makes it possible to bring a spindle 6, unloaded beforehand and provided with at least one virgin sleeve (within the meaning of the invention, a sleeve is a support made of plastic or cardboard intended to receive the strand package 8), into the winding position and another spindle, with its full sleeves, into the unloading position by rotating it through 180°.

Each of the spindles fastened to the drum constitutes a rotating assembly designed to draw and wind the strand onto a sleeve introduced beforehand onto the spindle 6. This winding operation is carried out about a first axis of rotation substantially parallel to the axis of rotation of the drum relative to the structure of the frame.

FIG. 1 shows another element that is essential for producing a package 8. This is the device 5 for positioning and guiding the strand on the spindle. In this example, it is a cursor 4 that can move within a groove, the cursor moving linearly along a second axis approximately parallel to the first axis, the assembly being mounted in a cassette that can move closer to or further away from the external peripheral surface of the package while it is being wound. This assembly is commonly called a "crossover device".

Other subassemblies needed to operate the winder are integrated into the frame.

The winder 1 includes at least one keeper 2 which is mounted so as to rotate relative to the frame (the reference 3 is the articulation point) and travels between a rest position, in which the strands are set back from the positioning and guiding device, and a working position, in which the strands are in contact with said positioning and guiding device. These two positions are visible in FIG. 2 (the keeper 2 is shown in the rest position by the dotted line and in the working position by the solid line.

This keeper 2, the angular position of which is slaved by an actuator of the motor type, the latter being controlled by a controller in such a way that the angular position of the keeper varies during the package winding phase.

More precisely still, by controlling the keeper it is possible to prevent a strand from flapping or vibrating between two stable points formed, on the one hand, by the gathering point (reference A in FIG. 1) downstream of the bushing and, on the other hand, by the point where the strand is deposited on the package (reference B).

During the winding phase, the keeper introduces an additional contact point along the path (A,B) of the strand, this additional contact point (referenced D in FIG. 2) acts in such a way that there is permanent engagement of the strand 7 within the crossover device 5 throughout the package winding phase, this engagement point being indicated by the point C in FIG. 2.

The keeper controls the geometry of the path of the strands over the entire winding operation, owing to the mobility of the deposition point (reference B) and of the strand engagement point in the strand guide (reference C) relative to the fixed point, represented by the gathering point (reference A). The geometry is controlled in this way by there being a minimum distance between the points B and C for good deposition precision and by an optimum engagement angle of the strand in the strand guide, this angle being illustrated in FIG. 2 by the reference E lying within the 9 to 15° range.

In the example shown in FIGS. 2 and 3, the keeper 2 is made in the form of a tubular brass bar supported by an arm articulated about a pivot axis 3, which is rotated by a motor positionally slaved electronically. This motor is controlled by the controller that manages, at the same time, the spindle speed and the retraction position of the crossover device according to the diameter of the package or packages with predefined parameters that will guarantee the quality of the deposition geometry.

As a variant, illustrated in FIGS. 4 and 5, the keeper 2 and an arm 9 for ejecting the strands 7 are combined on one and the same support, the ejection arm 9 being used to expel the strands 7 from the crossover device 5, either the phase of strand transfer from one spindle to another, or upon restarting strand winding onto a spindle following a strand breakage.

The ejection arm 9 is made in the form of a bar but projects laterally from a side wall of the closed structure of the frame. It can occupy two positions, namely a rest position (FIG. 4) in which it is set back from the path of the strands 7, and a working position (FIG. 5) in which it keeps the strand above the spindle nose during the restart. This working position of the ejection arm is also occupied during a transfer operation (rotation of the drum and switching from one spindle with wound packages to a spindle with empty sleeves).

As the winding proceeds (and the thickness of strands on the package increases), the crossover device 5 moves further away from the external peripheral surface of the package and the keeper guarantees permanent contact of a strand at the point C of the crossover device.

The invention claimed is:

1. A winder comprising:

a frame including at least one spindle configured to support at least one package, the spindle rotating about a first axis approximately perpendicular to the diameter of the package so as to draw and wind thereon at least one strand in a form of a package;

at least one traversing positioning and guiding device configured to position and guide the at least one strand on the rotating spindle, the device configured to move closer toward or further away from the package while the at least one strand is being wound; and a keeper configured to engage the at least one strand at a location upstream of the positioning and guiding device relative to a direction of movement of the at least one strand being wound on the rotating spindle, to alter the path of the at least one strand at the location upstream of the positioning and guiding device and thereby to keep the at least one strand in contact with the positioning and guiding device, the keeper being mounted so as to rotate relative to a second axis approximately parallel to the first axis of rotation and including a bar supported by an arm articulated about the second axis of rotation, the arm being controlled angularly by an indexer to keep the at least one strand in contact with the traversing positioning and guiding device.

2. The winder as claimed in claim 1, wherein the keeper is mounted so as to move relative to the frame and travels between a rest position, in which the at least one strand is away from the positioning and guiding device, and a working position, in which the at least one strand is in contact with the positioning and guiding device.

3. The winder according to claim 1, wherein the keeper also includes a rotary arm for ejecting the at least one strand, which serves to extract the at least one strand from the positioning and guiding device when being transferred from one spindle to another, or upon restarting strand winding onto a spindle following a strand breakage.

4. The winder as claimed in claim 1, wherein the indexer is configured to continuously modify the angular position of the keeper relative to the frame according to a variation in outside diameter of the package so as to minimize the travel of the at least one strand between its points of contact with the positioning and guiding device and its point of contact on the periphery of the package.

* * * * *